US005385220A

United States Patent [19]

Pond et al.

[11] Patent Number: 5,385,220

[45] Date of Patent: Jan. 31, 1995

[54] CARRY-ON CASE HAVING WHEELS AND AN EXTENDABLE HANDLE

[75] Inventors: Cecil E. Pond, Palm City, Fla.; Gary E. Pond, South Bend, Ind.

[73] Assignee: Porter Case, Inc., South Bend, Ind.

[21] Appl. No.: 966,138

[22] Filed: Oct. 23, 1992

[51] Int. Cl.[6] ..... A45C 5/14; A45C 9/00; A45C 13/26

[52] U.S. Cl. ..... 190/18 A; 190/115; 280/37; 280/655.1

[58] Field of Search ..... 190/18 A, 18 R, 115; 280/37, 39, 47.315, 655,

[56] References Cited

U.S. PATENT DOCUMENTS

| | | | |
|---|---|---|---|
| 832,628 | 10/1906 | Schreffler | 190/18 A X |
| 905,759 | 12/1908 | Strauss | 190/18 A X |
| 1,125,441 | 1/1915 | Bailey | 190/18 A X |
| 2,510,754 | 6/1950 | Norlin | 190/18 A X |
| 2,720,911 | 10/1955 | Lantz | 280/38 X |
| 3,522,955 | 8/1970 | Warner, Jr. | 190/18 A X |
| 3,709,513 | 1/1973 | Cassimally et al. | 280/37 |
| 3,960,252 | 6/1976 | Cassimally | 190/18 A |
| 4,273,222 | 6/1981 | Cassimally et al. | 190/18 A |
| 4,340,132 | 7/1982 | Cerna | 190/18 A |
| 4,724,681 | 2/1988 | Bartholomew et al. | 190/18 A X |
| 4,795,186 | 1/1989 | Tyusa | 280/37 X |
| 4,900,043 | 2/1990 | Kho | 190/18 A X |
| 5,114,164 | 5/1992 | Bothwell et al. | 280/37 |
| 5,116,289 | 5/1992 | Pond et al. | 190/18 A |

FOREIGN PATENT DOCUMENTS

| | | | |
|---|---|---|---|
| 867582 | 8/1941 | France | 190/18 A |
| 899995 | 9/1944 | France | 190/18 A |
| 2409720 | 7/1979 | France | 190/18 A |
| 2598897 | 11/1987 | France | 190/18 A |
| 2014271 | 10/1971 | Germany | 190/18 A |

*Primary Examiner*—Sue A. Weaver
*Attorney, Agent, or Firm*—James D. Hall

[57] ABSTRACT

An improved durable and damage resistant carry-on case having a built-in travel cart capable of being towed by itself or with several pieces of luggage. The handle of the cart can be retracted for convenient storage.

5 Claims, 11 Drawing Sheets

CARRY-ON CASE HAVING WHEELS AND AN EXTENDABLE HANDLE

FIELD OF THE INVENTION

This invention relates to carry-on luggage and has specific but not limited application to a durable lightweight carry-on case having a new improved built-in wheel and handle assembly for portable travel convenience.

BACKGROUND OF THE INVENTION

Conventional carry-on luggage and cases are typically hand-carried throughout an airport from places of departure to airplanes, from airplanes to airplanes, and from airplanes to places of arrival. For convenience, separate wheeled frames are often used to serve as a cart onto which the case can be strapped for transport. There are also cases that include incorporated handles and wheels so that the cases can be pulled by the handles, thereby permitting them to be towed about and transported throughout the airport. A problem with these prior art carry-on cases exists in that it is impractical, if not impossible, to use these cases as a support upon which to stack additional pieces of luggage without special devices or attachment hooks.

An improved carry-on case was developed and is the subject of U.S. Pat. No. 5,116,289. This case includes an extendable handle assembly which allows the case to be towed in a truck position with luggage stacked upon it. The pivot for the handle assembly is a rod that is retained in a transverse channel formed in the lid of the case. This channel decreased the internal space of the carry-on case.

The prior art case in U.S. Pat. No. 5,116,289 may also be susceptible to damage at its end wall when the case was in the truck position supporting other luggage or cases. In its truck position, the case can be pulled up over curbs or through swinging doorways where the Year end wall of the case is exposed to scratching, scuffing and being dented.

SUMMARY OF THE INVENTION

The carry-on case of this invention serves to alleviate the problem and inconvenience of transporting cumbersome luggage casts. This case includes an exteriorly storable built-in handle assembly which can function as a luggage travel cart by which the case can be pulled. Unlike the case shown in U.S. Pat. No. 5,116,289, the case of this invention has a modified pivot for the handle assembly which eliminates the need for a transverse channel in the case lid. This modification permits more space inside the case compared to the case of U.S. Pat. No. 5,116,289.

The case of this invention uses an extendable handle which is positioned over the end of the case when the case is in its truck position. In this manner the end wall is no longer, exposed to damage and abuse with the handle functioning as a natural skid plate to protect against bumping, banging and scraping as the case is pulled up and over curbs.

It is therefore an object of this invention to provide for a novel carry-on case.

Another object of this invention is to provide for a case with wheels and an exteriorly storable built-in handle functioning as a travel cart.

Another object of this invention is to provide for a case with wheels and a built-in collapsible handle that can be used to carry stacked luggage.

Other objects of the invention will become apparent upon a reading of the following description taken with the accompanying drawings.

DESCRIPTION OF THE PREFERRED EMBODIMENT

Figure 1:
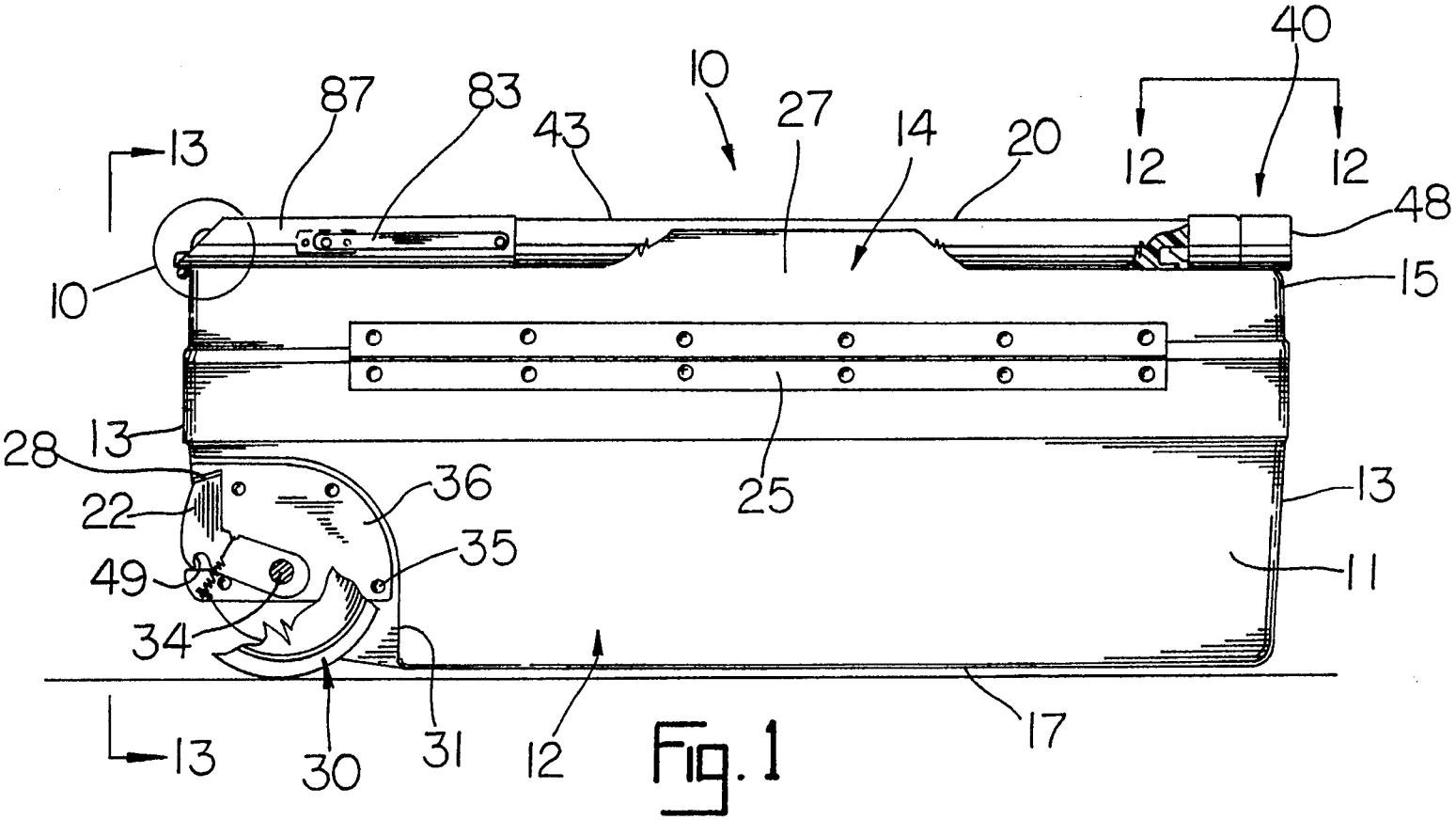
FIG. 1 is a side view of the carry-on case of this invention with its lid in a closed position and its handle in a collapsed and lowered positions.

The preferred embodiment illustrated is not intended to be exhaustive or to limit the invention to the following given details. Rather, it is chosen and described to explain the principles of the invention, its application and practical use to enable others skilled in the art to utilize the invention.

Case 10 includes a base 12 and a lid 14 both of which are connected and held together by rear hinges 25. Case 10 also includes two wheels 30 and a handle assembly 40 that is releasably extendable, collapsible, lowerable and raisable.

Figure 2:
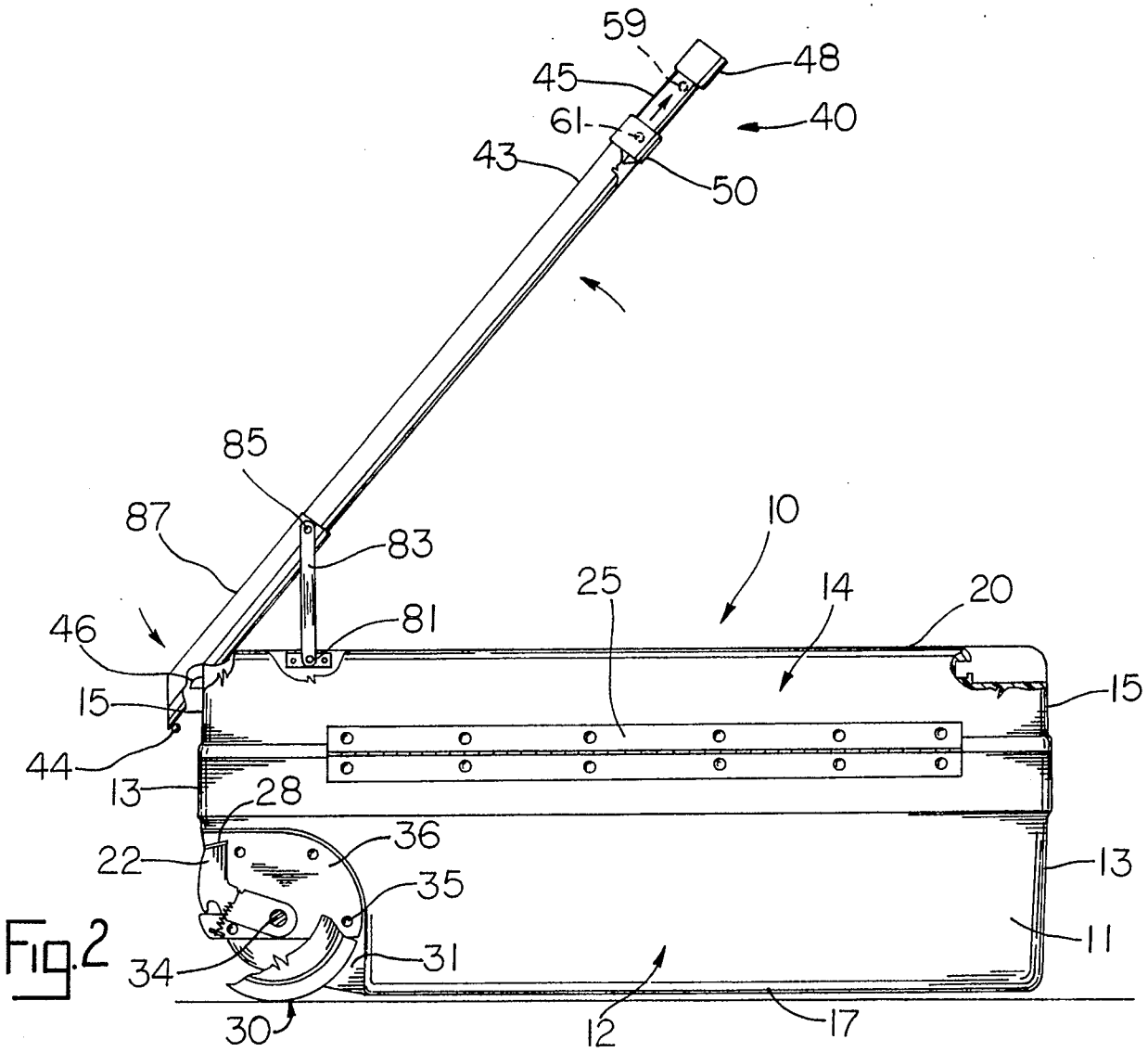
FIG. 2 is a side view of the carry-on case which shows its handle in an intermediate raised position.

Base 12 of case 10 includes a bottom wall 17, two end walls 13, a rear wall 11 and a front wall 19. Front wall 19 carries locks 16. Lid 14 is shiftable about hinges 25 from an open position to a closed position as illustrated in FIGS. 1 and 2. Lid 14 includes a top wall 20, two end walls 15, a rear wall 27 and a front wall 21. Front wall 21 includes latches (not shown) which interlock with locks 16 to secure lid 14 in its closed position over base 12.

Figure 7:
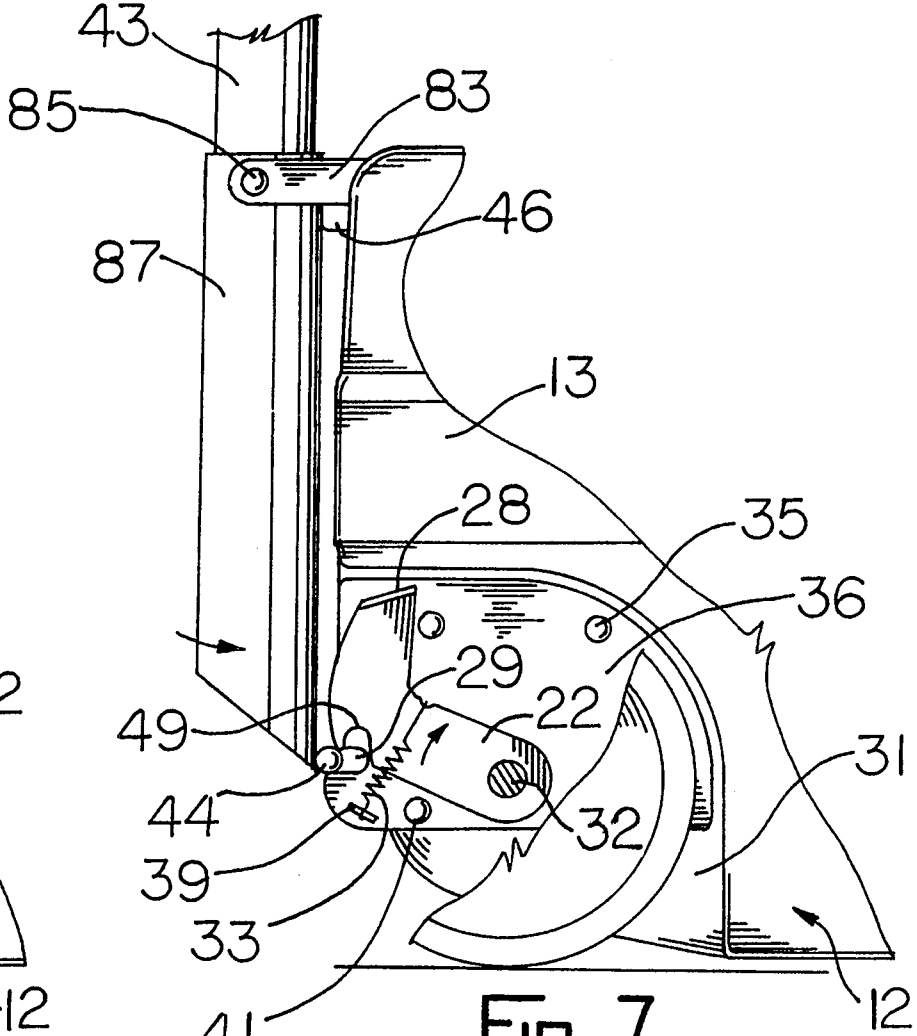
FIG. 7 is a detailed fragmentary view of the handle being secured in its raised position.
Figure 6:
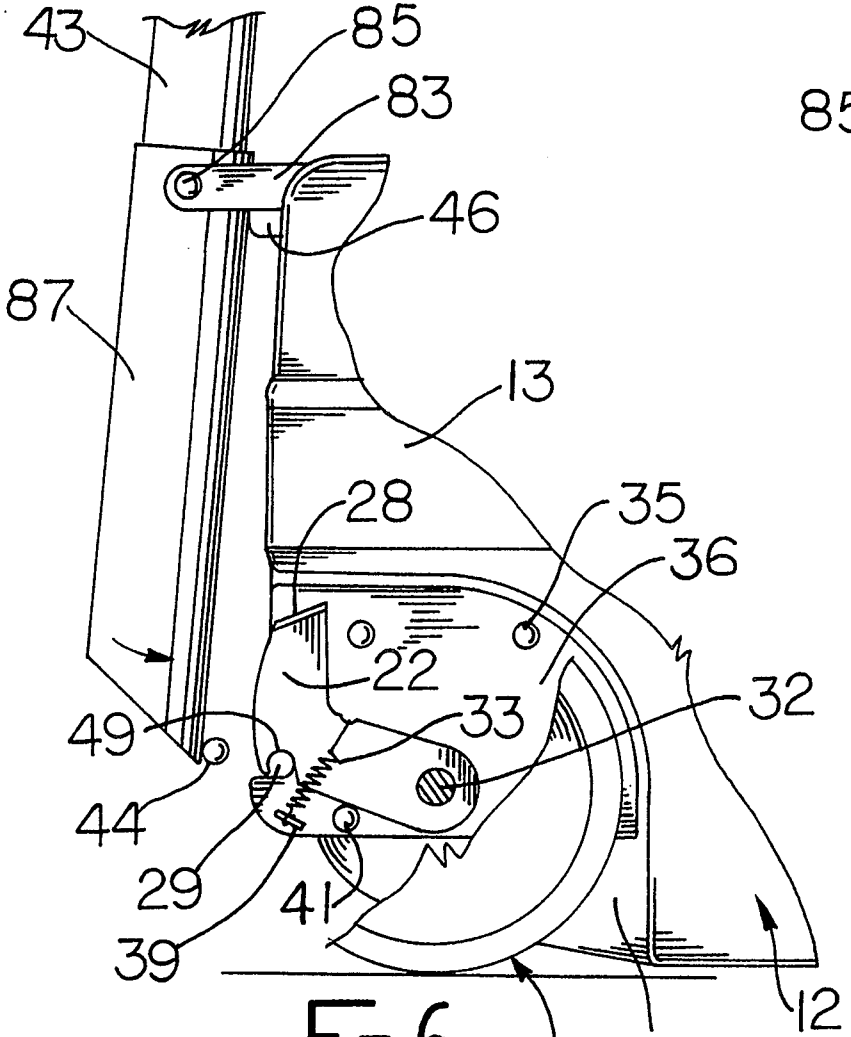
FIG. 6 is a detailed fragmentary view of the handle is being raised about the lowered case to accomplish the truck position.

Wheels 30 are positioned on opposite sides of base 12 in wheel wells 31 formed in walls 11 and 19. Wheels 30 are rotatively journaled about an axle 32 which extends across the width of bottom wall 17 of base 12. Press-fitted caps 34 retain wheels 30 upon axle 32. Axle 32 extends through and is journaled in wheel plates 36 that are secured to base 12 at walls 11 and 19 within wheel wells 31 by fasteners 35. A latch 22 is positioned on the outside of each of the wheel plates 36. Each latch 22 is pivotally located about axle 32. As best seen in FIGS. 6 and 7, each latch 22 is held against a wheel plate pin 41 by a helical spring 33. Each spying 33 is secured at one end over an upper edge of its associated latch 22 and at its opposite end to a wheel plate tab 39.

Handle 40 of case 10 is releasably extendable, collapsible, lowerable and raisable as shown in FIGS. 1–5. Handle 40 includes two parallel side rails. Each side rail includes an outer telescopic member 43 having a lower skid or cover 87 and an inner telescopic member 45. Outer telescopic members 43 are joined at corresponding ends by a cross brace 50 and at their opposite corresponding ends by a rod 44.

Figure 10:
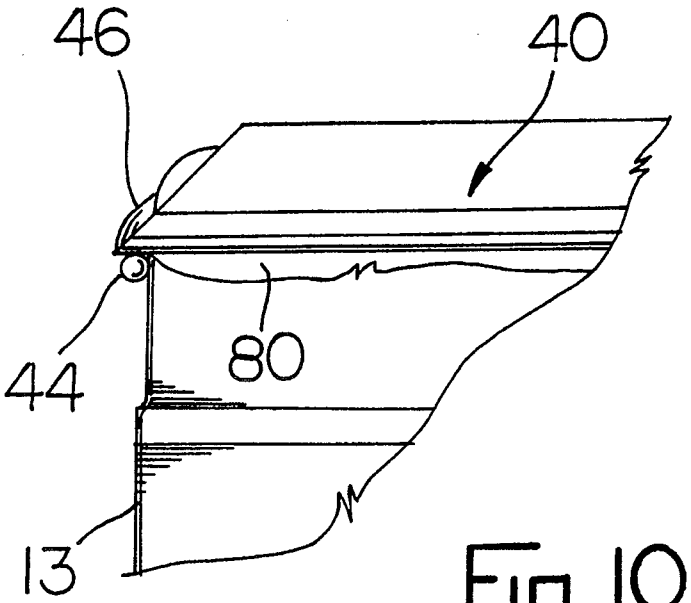
FIG. 10 is an enlarged view of the encircled portion 10 of the handle seen in FIG. 1.
Figure 12:
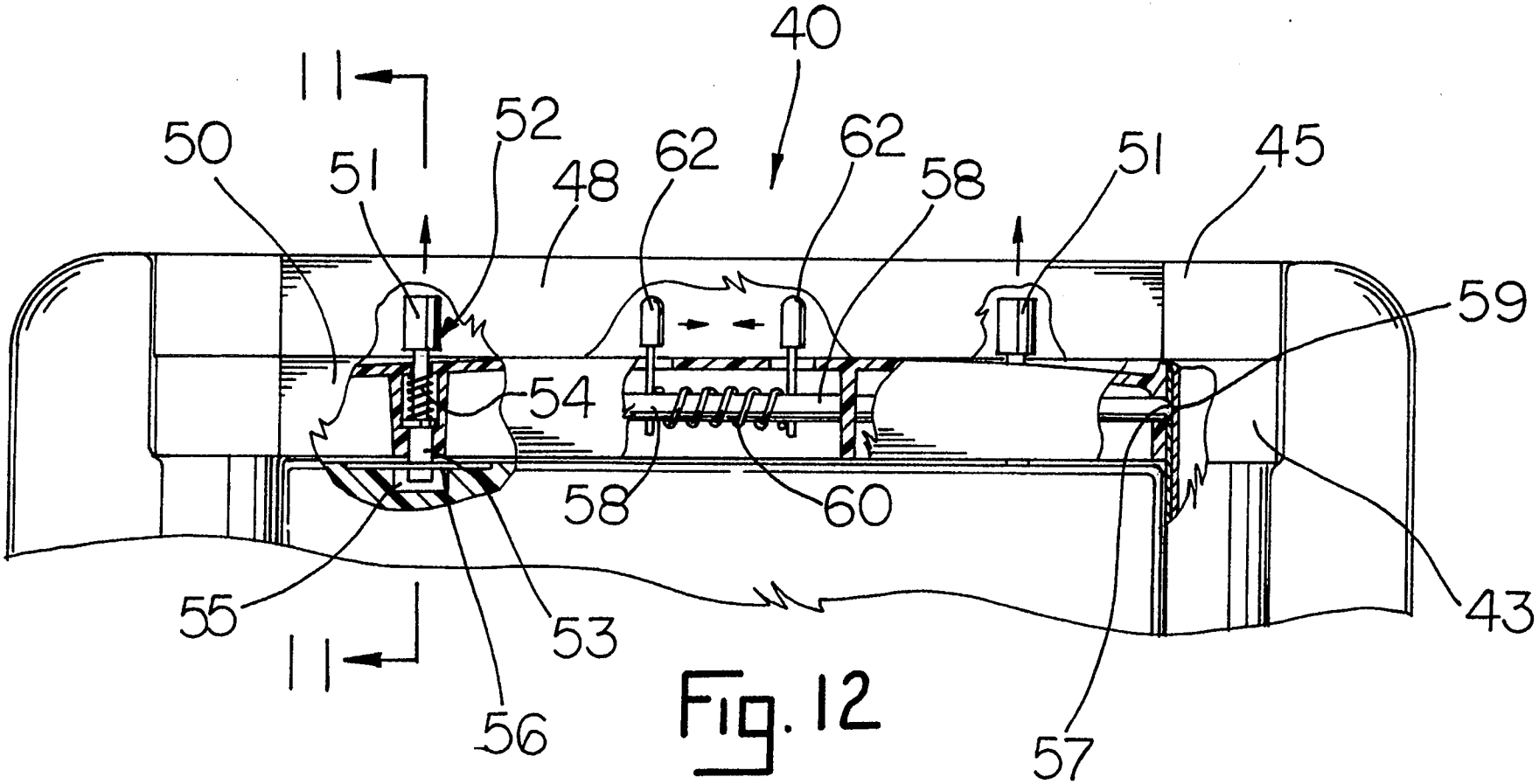
FIG. 12 is a fragmentary sectional view of the handle as seen along line 12—12 of FIG. 1.
Figure 13:
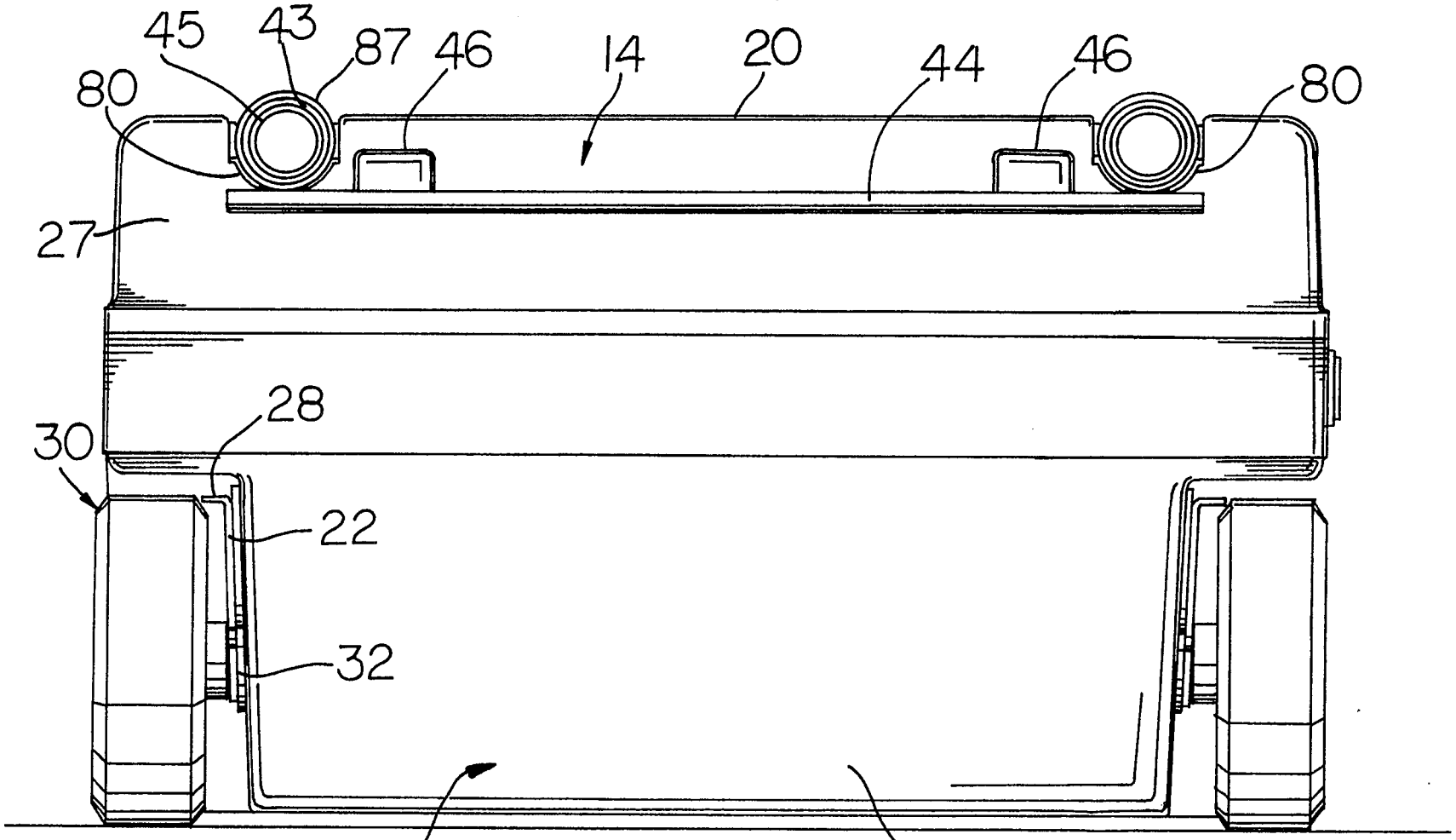
FIG. 13 is a rear view of the case as seen along line 13—13 of FIG. 1.
Figure 14:
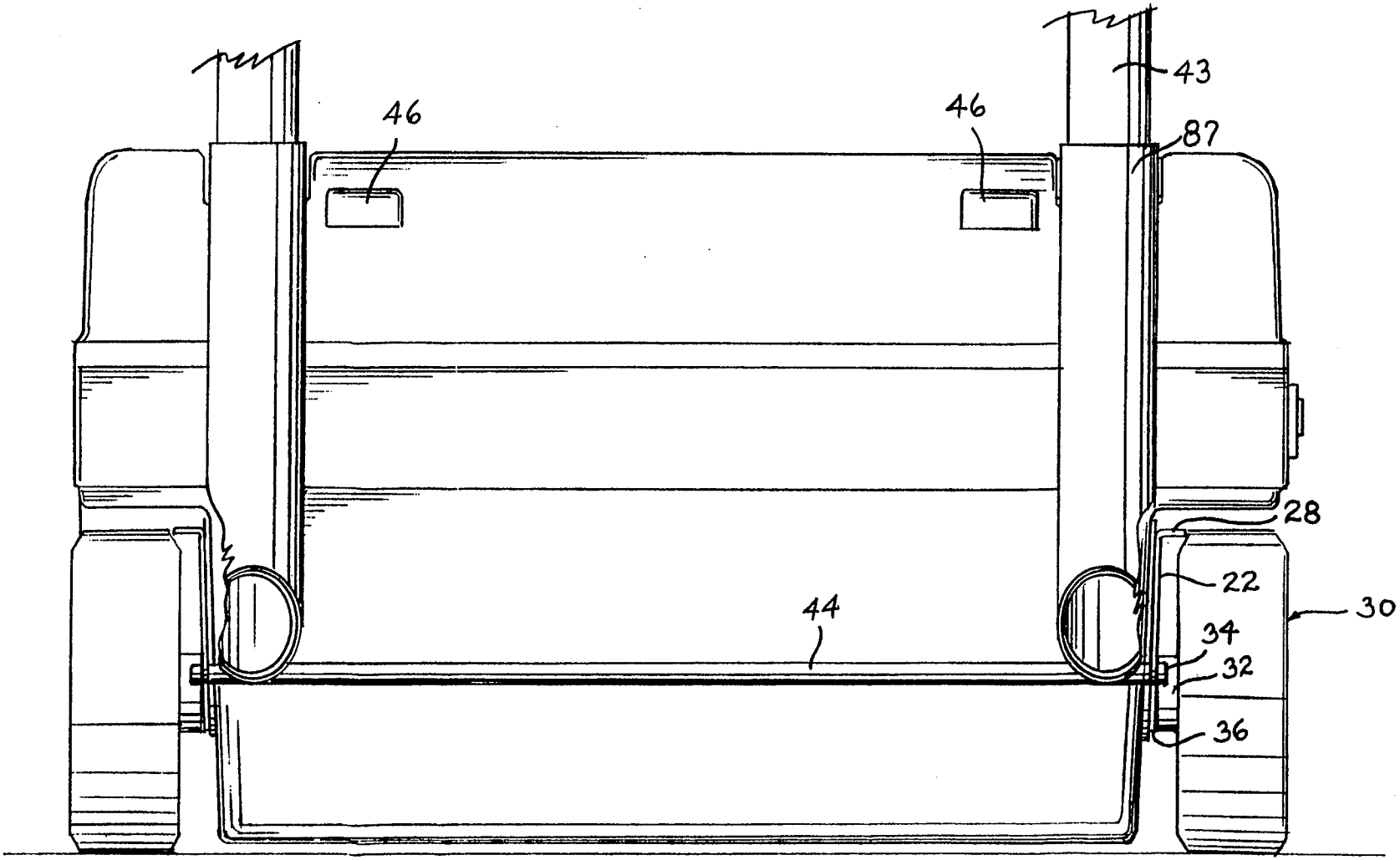
FIG. 14 is a rear view of the case showing its handle in its raised position.

With the handle in its collapsed position, outer telescopic members 43 are retained by hinged links 83 in parallel channels 80 formed in lid 14. A link 83 is located at each side of each telescopic member 43 and is pivotally attached at one end to lid 14 by an anchor plate 91 positioned in the adjacent channel 80 and attached by rivets or other suitable fasteners to the lid. At its opposite end, each link 83 is pivotally connected by a pin 85 to the telescopic member 43. When handle 40 is moved from its raised position shown in FIG. 3 to its lowered position shown in FIGS. 4, 10 and 13, rod 44 which extends between outer telescopic members 43 is cammed under stops 46 on end wall 15 of lid 14 as seen in FIGS. 10 and 13. This prevents the link connected end of the handle from being raised out of lid channels 80.

Hand grip 48 is connected to inner telescopic members 45 of handle 40 at their free ends. Inner telescopic members 45 are shiftable relative to outer telescopic members 43 to allow handle 40 to assume the collapsed position seen in FIG. 1 and the extended position seen in FIGS. 2 and 3. The extension of handle 40 is accomplished by pulling out on hand grip 48, Handle 40 is selectively secured in its collapsed position or extended position by means of a locking system which is housed in and carried by a handle cross brace 50 which extends between the ends of outer telescopic members 43. This locking system includes two lock rods 58 which are oppositely extending and are axially aligned. Lock rods 58 are retained within cross brace 50 and protrude through guide holes 57 formed in the inside of outer telescopic members 43 and aligned lock holes 59 in inner telescopic members 45. Each of lock rods 58 can be retracted out of lock holes 59 to permit inner telescopic members 45 to shift between the extended and collapsed positions.

Lock rods 58 are normally urged outwardly into a protruding position relative to lock holes 59 by a helical spring 60. Each end of helical spring 60 extends about an inner end of lock rod 58, abutted compressively against a transverse grip pin 62. Each grip pin 62 is press-fitted through a lock rod 58. Grip pins 62 extend outwardly through cross brace 50 to an exposed position that is adjacent to hand grip 48 when handle 40 is in its collapsed position. The shifting or squeezing together the exposed ends of grip pins 62 compresses helical spring 60 and draws lock rods 58 together to cause the outer ends of lock rods 58 to be withdrawn from lock holes 59 of inner telescopic members 45, freeing handle 40 and permitting it to be extended.

Figure 3:
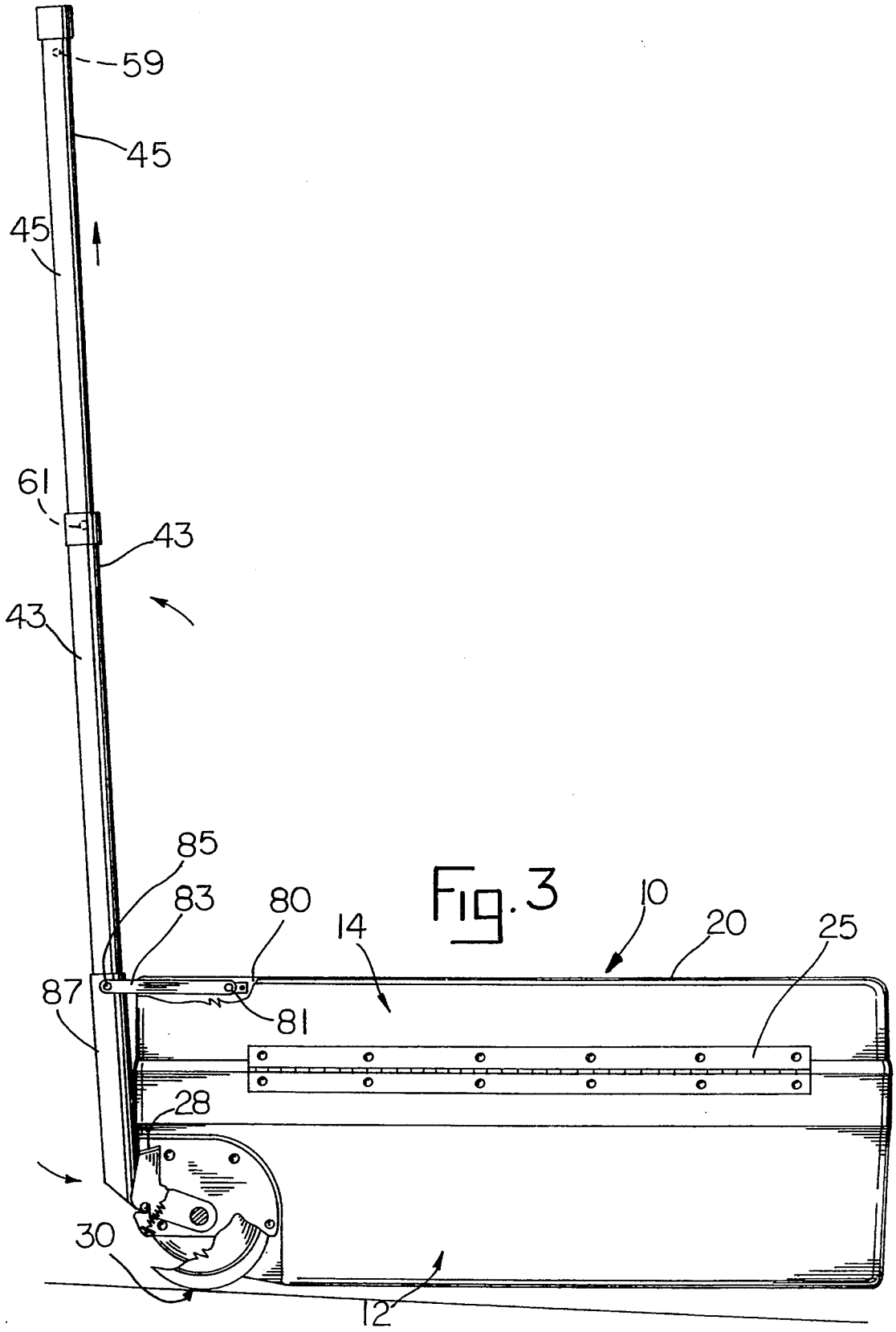
FIG. 3 is a side view of the carry-on case with its handle in the raised and extended positions.
Figure 4:
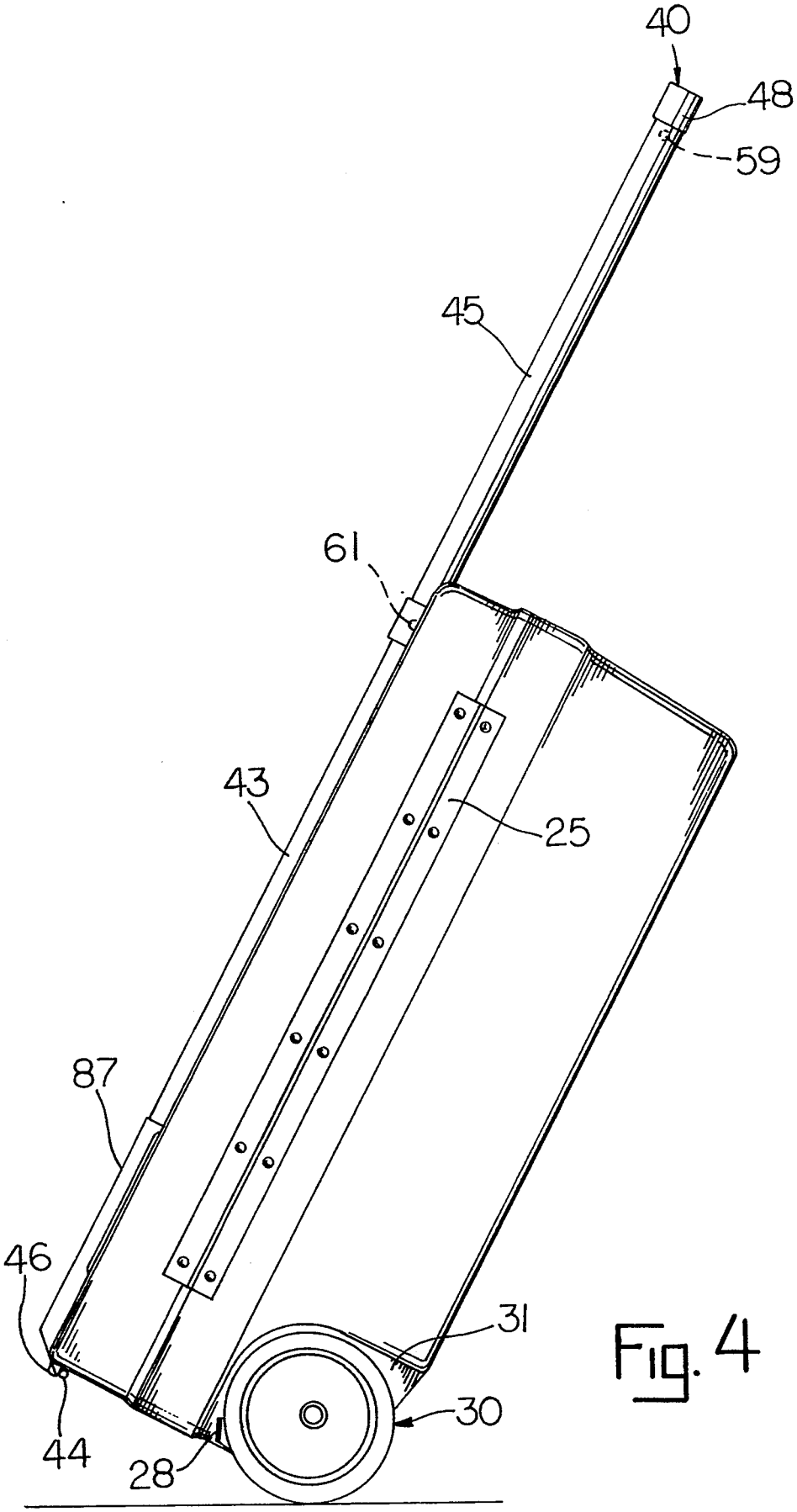
FIG. 4 is a side view of the carry-on case which shows the case in a tilted position about its wheels with its handle in its extended and lowered positions.

To secure handle 40 in its extended position, inner telescopic members 45 have formed at their opposite ends a second set of lock holes 61. As inner telescopic members 45 are shifted and releasably extended, lock rods 58 align with the lock holes in inner telescopic members 45 to permit each of lock rods 58 to be again urged by helical spring 60 into an inner lock hole 61 to secure handle 40 in its extended position as shown in FIGS. 3–4.

Figure 8:
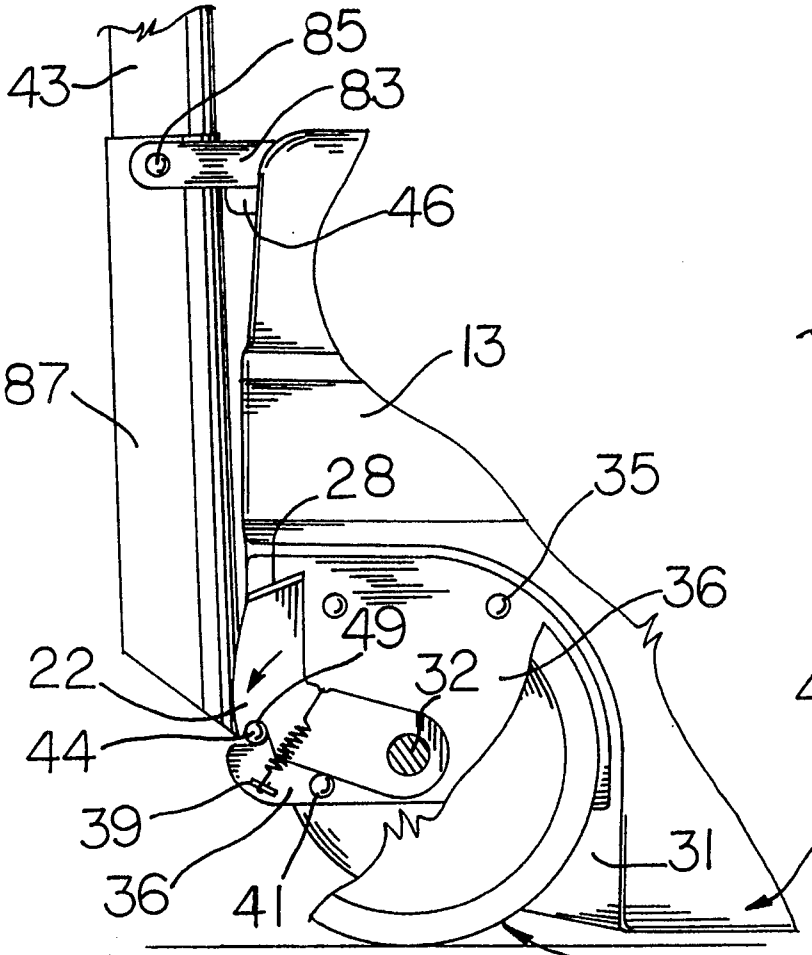
FIG. 8 is a detailed fragmentary view of the handle locked in its raised position.
Figure 11:
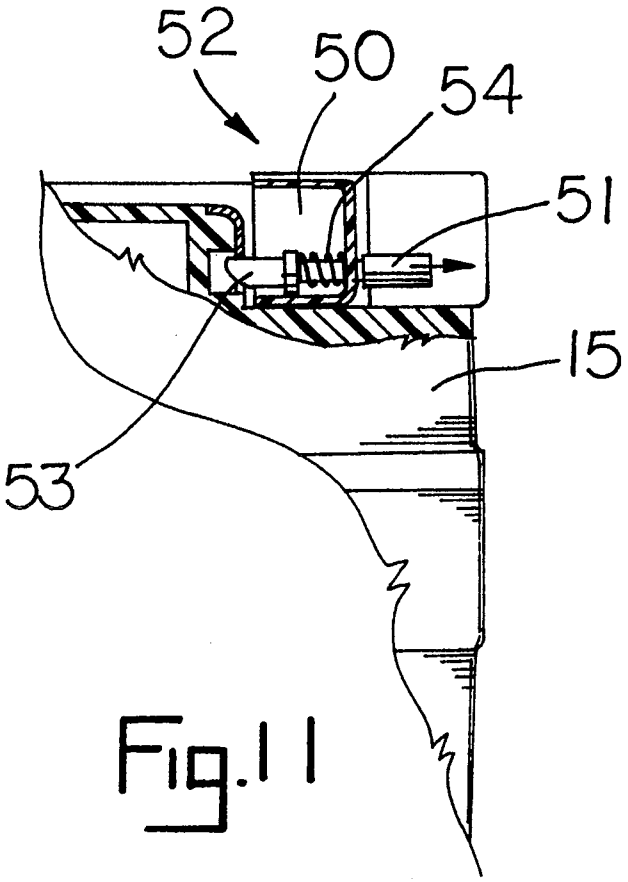
FIG. 11 is a fragmentary sectional view of the handle taken along line 11—11 of FIG. 12.

To secure handle 40 in its raised position, rod 44 is seated within a hooked recess 49 in each latch 22 as seen in FIG. 8. FIGS. 6–8 show handle 40 being progressively raised with rod 44 first entering slot 29 in each wheel plate 36 and simultaneous camming the connected latch 22 upwardly to allow the end to be seated in the latches hooked recess. Each spring 33 serves to hold its connected latch 22 in locking engagement with handle rod 44.

Figure 5:
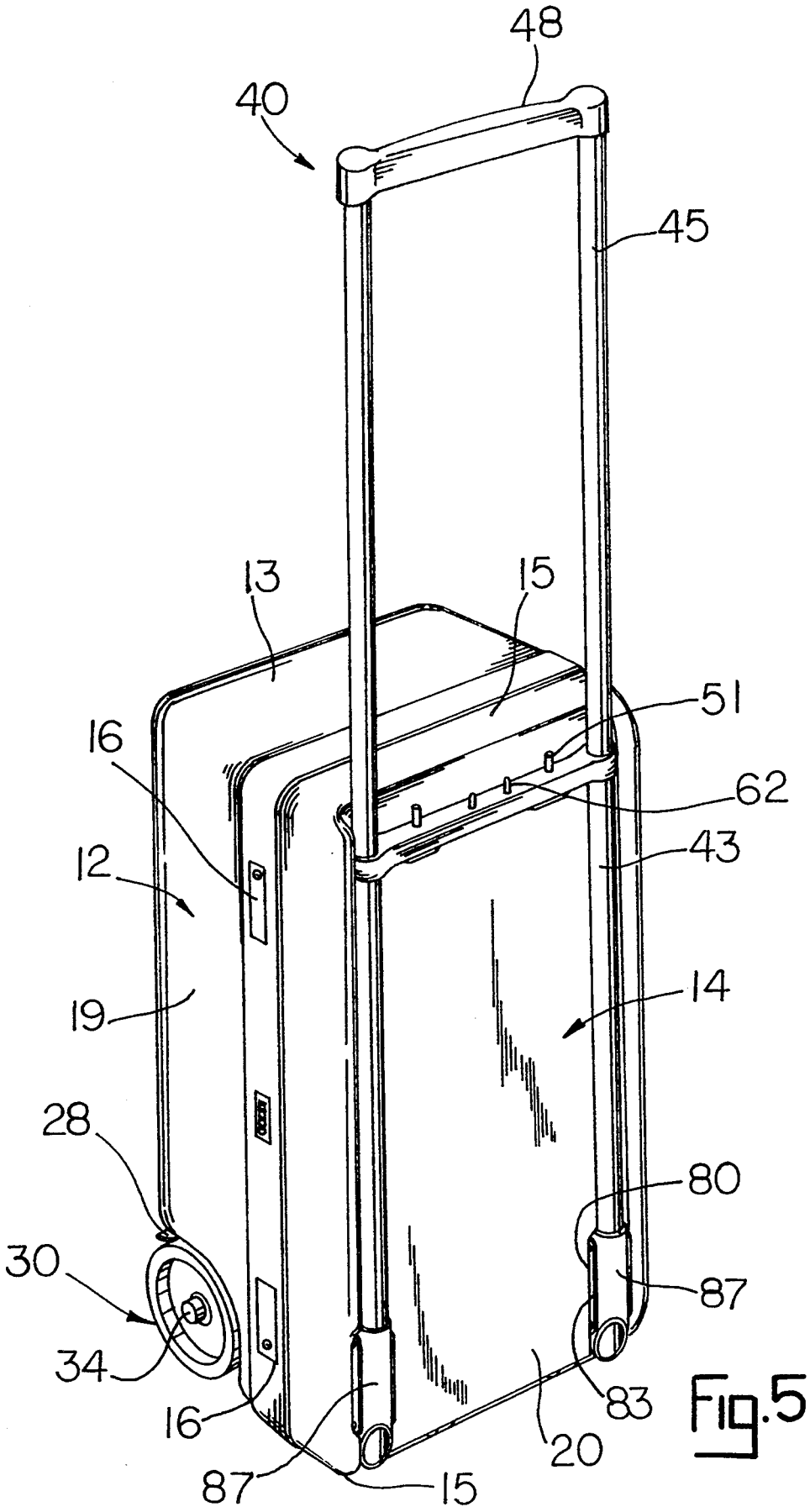
FIG. 5 is a rear perspective view of the carry-on case with its handle in its extended and lowered position.
Figure 9:
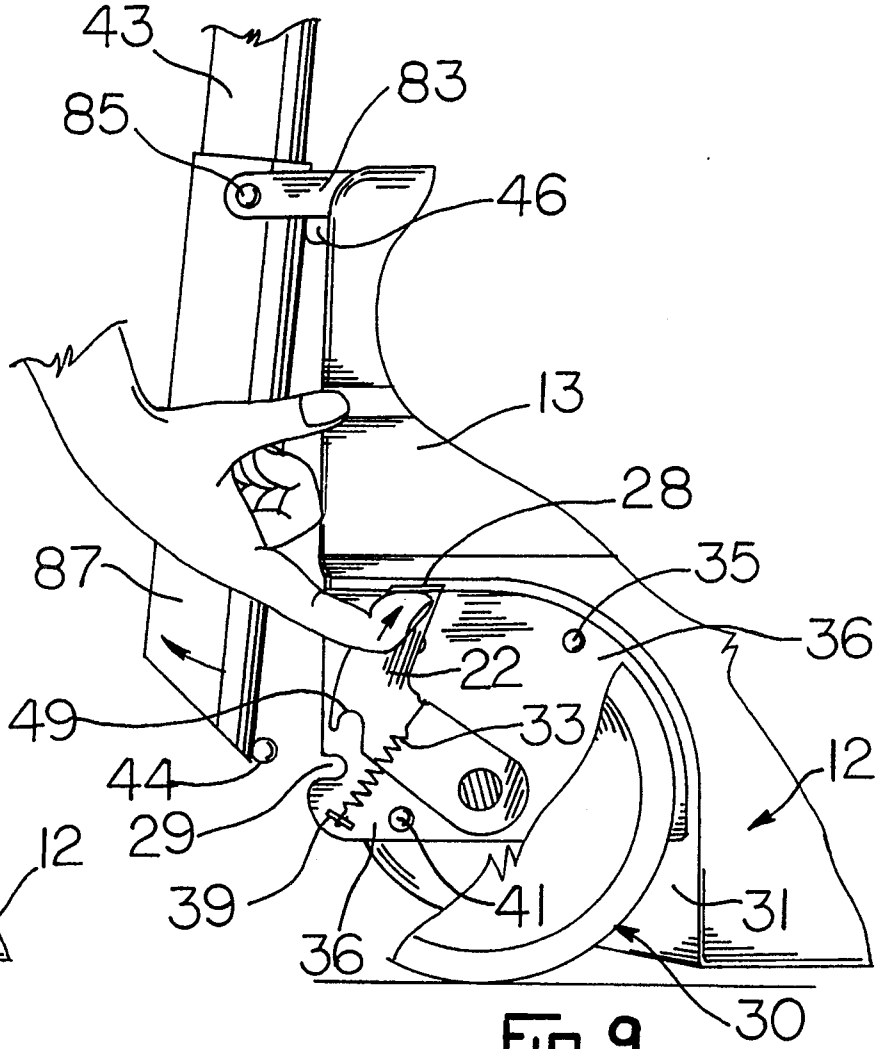
FIG. 9 is a detailed fragmentary view showing the handle being released from its locked raised position.

To achieve the carry position or tow position as shown in FIGS. 1 and 5, respectively, it is necessary to release handle 40 from its raised and locked position shown in FIG. 8. To do so, the case user reaches next to each wheel 30 on each side of the case and presses up on the release tab 28 of each latch 22 as seen in FIG. 9. This causes the helical latch springs 33 to be extended with latches 22 being pivoted upwardly. This releases rod 44, permitting handle 40 to be pivoted over lid 14 so that rod 44 fits snugly underneath stops 46 and the handle 40 can be locked onto lid 14 in the following manner.

In its lowered and collapsed position as shown in FIG. 1, handle 40 is secured to lid 14 by another handle locking system. Two lock pins 52 are retained within cross brace 50 and include head parts 51 and shank parts 53. Each head part 51 projects from cross brace 50 next to a grip pin 62. Each shank part 53 protrudes through an opening in cross brace 50. The head part 51 of each pin 52 is threaded onto a shank part 53. A helical spring 54 extends about each lock pin shank part 53 and is compressed between brace 50 and a shoulder on the shank part so as to urge the pin towards a strike plate 56 attached to lid end wall 15 when the handle is in its lowered position. The protruding end of each shank part 53 is forced by spring 54 into a lock hole 55 under strike plate 56 in lid wall 15 to secure handle 40 in its lowered position.

To release handle 40 from its lowered position in order to allow the handle to be pivoted into its raised position, the user need only grasp head parts 51 of lock pins 52 and pull. This causes helical springs 54 to be compressed with shank parts 53 being withdrawn from lock holes 55 in the lid.

When handle 40 is moved into its extended and raised position shown in FIG. 3, case 10 is in its truck position and luggage composed of from 4 to 5 suitcases can be stacked upon closed lid 14 and rested against handle 40. FIG. 4 illustrates case 10 in its towable position in which handle 40 is extended in its lowered position. In this position the case 10 can be pivoted upwards to permit towing. FIG. 1 illustrates case 10 with handle 40 in its lowered and collapsed positions with handle 40 being usable at grip 48 to carry case 10. Sufficient spacing is provided between grip 48 and brace 50 to allow the grip to be grasped by the hand of the user.

It is understood that the above description does not limit the invention to those details, which may be modified within the scope of the following claims.

We claim:

1. A carrying case comprising a base and a lid, a hinge member connecting said lid to said base for shiftable movement between an open position exposing the interior of said base and a secured closed position overlying the base, wheels rotatively connected to said base adjacent one end of said base, handle means pivotally connected to said lid and being shiftable between a lowered position overlying the lid and a raised position extending upwardly from the lid, said handle means for tilting said base with said lid in its closed position upwardly about said wheels when the handle means is in its raised position, securing means for releasably locking said handle in its raised position, said lid forming means for supporting articles thereon with the lid is closed and said handle means is in its raised and secured position, said handle means for tilting said base with said lid in its closed position upwardly about said wheels when the handle means is in its lowered position to tow the base and lid, securing means for releasably locking said handle in its lowered position, said handle including spaced side rails straddling said lid and a link means pivotally connecting each rail to said lid, each link means for guiding its said connected rail from a horizontal position over said lid when said handle is in its lowered position to a generally vertical position behind said base when said handle is in its raised position.

2. The case of claim 1 wherein said first mentioned securing means is carried by said base.

3. The case of claim 2 wherein said first mentioned securing means includes a latch part carried by said base, at least one of said rails having a catch part engagable with said latch part.

4. The case of claim 3 wherein said catch part is a rod extending between said rails, said latch part located adjacent one of said wheels.

5. The case of claim 4 wherein said first mentioned securing means includes a second latch part carried by said base and located adjacent another of said wheels, said rod engaging said latch parts when said handle is in its raised position.

* * * * *